US011486136B2

(12) United States Patent
Scott et al.

(10) Patent No.: US 11,486,136 B2
(45) Date of Patent: Nov. 1, 2022

(54) FIRE RESISTANT COATING SYSTEM AND METHOD

(71) Applicants: Paul Craig Scott, Houston, TX (US); Aaron Feinberg, Belmont, NC (US)

(72) Inventors: Paul Craig Scott, Houston, TX (US); Aaron Feinberg, Belmont, NC (US)

(73) Assignee: Intumescents Associates Group (IAG), LLC, Houston, TX (US)

( * ) Notice: Subject to any disclaimer, the term of this patent is extended or adjusted under 35 U.S.C. 154(b) by 607 days.

(21) Appl. No.: 16/378,167

(22) Filed: Apr. 8, 2019

(65) Prior Publication Data

US 2019/0316347 A1 Oct. 17, 2019

Related U.S. Application Data

(60) Provisional application No. 62/658,256, filed on Apr. 16, 2018.

(51) Int. Cl.

| | |
|---|---|
| ***E04B 1/94*** | (2006.01) |
| ***D03D 1/00*** | (2006.01) |
| ***D03D 19/00*** | (2006.01) |
| ***D03D 15/513*** | (2021.01) |

(52) U.S. Cl.

CPC ..... *E04B 1/944* (2013.01); *D03D 1/0035* (2013.01); *D03D 15/513* (2021.01); *D03D 19/00* (2013.01); *E04B 1/941* (2013.01); *D10B 2101/12* (2013.01); *D10B 2331/02* (2013.01); *D10B 2331/04* (2013.01); *D10B 2331/061* (2013.01)

(58) Field of Classification Search

None

See application file for complete search history.

(56) References Cited

U.S. PATENT DOCUMENTS

| | | | |
|---|---|---|---|
| 2,461,240 | A | 2/1949 | Scruggs |
| 3,913,290 | A | 10/1975 | Billing et al. |
| 4,069,075 | A | 1/1978 | Billing et al. |
| 4,320,160 | A | 3/1982 | Nishimura et al. |
| 4,529,467 | A | 7/1985 | Ward et al. |
| 5,433,991 | A | 7/1995 | Boyd, Jr. et al. |
| 5,580,648 | A | 12/1996 | Castle et al. |
| 7,857,013 | B2 | 12/2010 | Wadahara et al. |
| 2015/0126089 | A1 | 5/2015 | Bischoff et al. |
| 2015/0167208 | A1 | 6/2015 | Bischoff |

*Primary Examiner* — Shawn Mckinnon

(74) *Attorney, Agent, or Firm* — Keeling Law, LLC; Kenneth A. Keeling; Mark S. Solomon

(57) ABSTRACT

Embodiments of a leno weave mesh of the present invention generally include a plurality of high-temperature weft yarns, high-temperature warp yarns, and low melting point warp yarns; wherein each low melting point warp yarn is intertwined with a high-temperature warp yarn, each intertwined pair of warp yarns is positioned such that the low melting point warp yarn and high-temperature warp yarn are disposed alternatingly on either side of the woven mesh at intersections of the weft and warp yarns, and the woven mesh is heated whereby the surfaces of the low melting point warp yarns adhere to the surface of the high-temperature warp yarns and said high-temperature weft yarns at contact points there between. An intumescent coating system employing embodiments of the mesh, and a method of providing thermal protection to a substrate utilizing the intumescent coating system, are also provided.

20 Claims, 6 Drawing Sheets

FIRE RESISTANT COATING SYSTEM AND METHOD

CROSS-REFERENCE TO RELATED APPLICATIONS

This application claims the benefit of U.S. Provisional Application No. 62/658,256, filed on Apr. 16, 2018, which application is incorporated herein by reference as if reproduced in full below.

STATEMENT REGARDING FEDERALLY SPONSORED RESEARCH OR DEVELOPMENT

Not applicable.

FIELD OF THE INVENTION

The present invention relates generally to fire resistant coatings, and more particularly to a fire resistant coating including an intumescent material, a support structure comprising a hot-melt yarn for supporting the intumescent material, and a related method.

BACKGROUND

Fire resistant coatings are useful for application to substrates to protect the substrate from extreme temperatures. The prior art teaches use of an intumescent fire resistant coating with a support structure.

Fire resistant coatings often include char-forming compositions. For example, U.S. Pat. No. 4,529,467, to Ward et al., teaches a fire resistant coating composition that produces a carbonaceous char. Intumescent coatings expand to form an insulating char structure upon exposure to sufficient heat. Intumescent coatings may swell to produce a char that is more than five times the original coating thickness. Such expansion, however, results in cracking and fissures in the coating structure, and often, separation of some or all of the coating from the substrate to be protected. To prevent the char from falling off the substrate to be protected, a support structure may be provided.

The differential temperature rise as a function of time across a sample substrate at specified conditions provides a measure of a coating's effectiveness in protecting a substrate from extreme temperatures.

U.S. Pat. No. 3,913,290, to Billing et al., describes an insulated reinforcement for use on structural members. The reinforcement is supported on the structural member and the fireproofing material placed thereabout. The reinforcement secures an insulation strip against the end of the structural flange. Fireproofing material is applied over the mesh and insulation strip to cover the flanges and webs of the structural member. The reinforcement may be constructed of a mesh-like member.

U.S. Pat. No. 5,443,991, to Boyd, Jr. et al., discloses a hybrid mesh fabric to reinforce char resulting from a fire and to prevent or reduce fissures in the mastic fire resistant coating. The '991 patent describes a fabric containing a high-temperature fibrous material with interweaving of a less-expensive low-temperature fibrous material with the high temperature fiber.

U.S. Pat. No. 4,069,075, to Billings et al., describes a structural support for char residue derived from a char forming intumescent coating on a structural member. The structural support includes a fire resistant mesh member attached to the structural member. A char forming intumescent coating is applied to the structural member so as to substantially encapsulate the entire mesh member so that the char residue, when formed, encapsulates the mesh member and is anchored to the structural member thereby. The mesh member is a wire mesh or a mesh formed from another fire resistant material.

U.S. Pat. No. 5,580,648, to Castle et al., discloses reinforcement for mastic intumescent fire protection coatings comprising free-floating carbon mesh embedded in the coating, or optionally, using carbon mesh with mechanically attached reinforcements. The '648 patent teaches use of carbon mesh as an alternative to more expensive and more rigid welded wire mesh.

A shortcoming of woven prior art support meshes for intumescent coatings is that the weave is fragile and therefore susceptible to structural degradation when draped about a substrate and/or when the intumescent coating material is applied to the mesh. In one aspect, the weave structure may be distorted wherein the mesh openings formed between the warp and weft yarns, which are consistent and regular in the mesh as woven, are disrupted, which leaves a support material having inconsistent and irregular mesh openings, which is undesirable.

Attempts have been made generally to alleviate or mitigate woven mesh instability. In U.S. Pat. No. 4,320,160, to Nishimura et al., bi-directional fabric reinforcement structure is disclosed. More recently, U.S. Patent Application Publications Nos. 2015/0167208, by Bischoff, and 2015/0126089, by Bischoff et al., disclose a reinforcing system for a woven fabric, wherein a reinforcing system 25 comprises weft threads 26 and warp threads 27.

While the prior art may provide some useful properties, there exists a need for a simpler woven mesh having a more stable structure. Embodiments of Applicants' invention comprise a reinforcing system comprising reinforcing threads oriented only in a single direction.

BRIEF SUMMARY OF THE INVENTION

Embodiments of the present invention comprise a woven mesh comprising a high-temperature yarn positioned in the warp (continuous machine) direction, a high-temperature yarn positioned in the weft (cross machine) direction, and a hot-melt yarn intertwined with each warp-direction high-temperature yarn, wherein the hot-melt warp yarn and the high-temperature warp yarn alternate their side-by-side positioning with each high-temperature weft yarn insertion in a leno weave (also known as a gauze weave or cross weave), and wherein the woven mesh is heated during the weaving process whereby the hot-melt yarn surface is softened so that it adheres to the high-temperature warp yarn at contact points there between and adheres to the weft high-temperature yarns at each intersection there between. Embodiments of a method of applying an intumescent coating in conjunction with embodiments of woven meshes of the present invention are also disclosed.

BRIEF DESCRIPTION OF THE DRAWINGS

For a more complete understanding of the exemplary embodiments, reference is now made to the following Description of Exemplary Embodiments of the Invention, taken in conjunction with the accompanying drawings, in which.

DESCRIPTION OF EXEMPLARY EMBODIMENTS OF THE INVENTION

Figure 1:
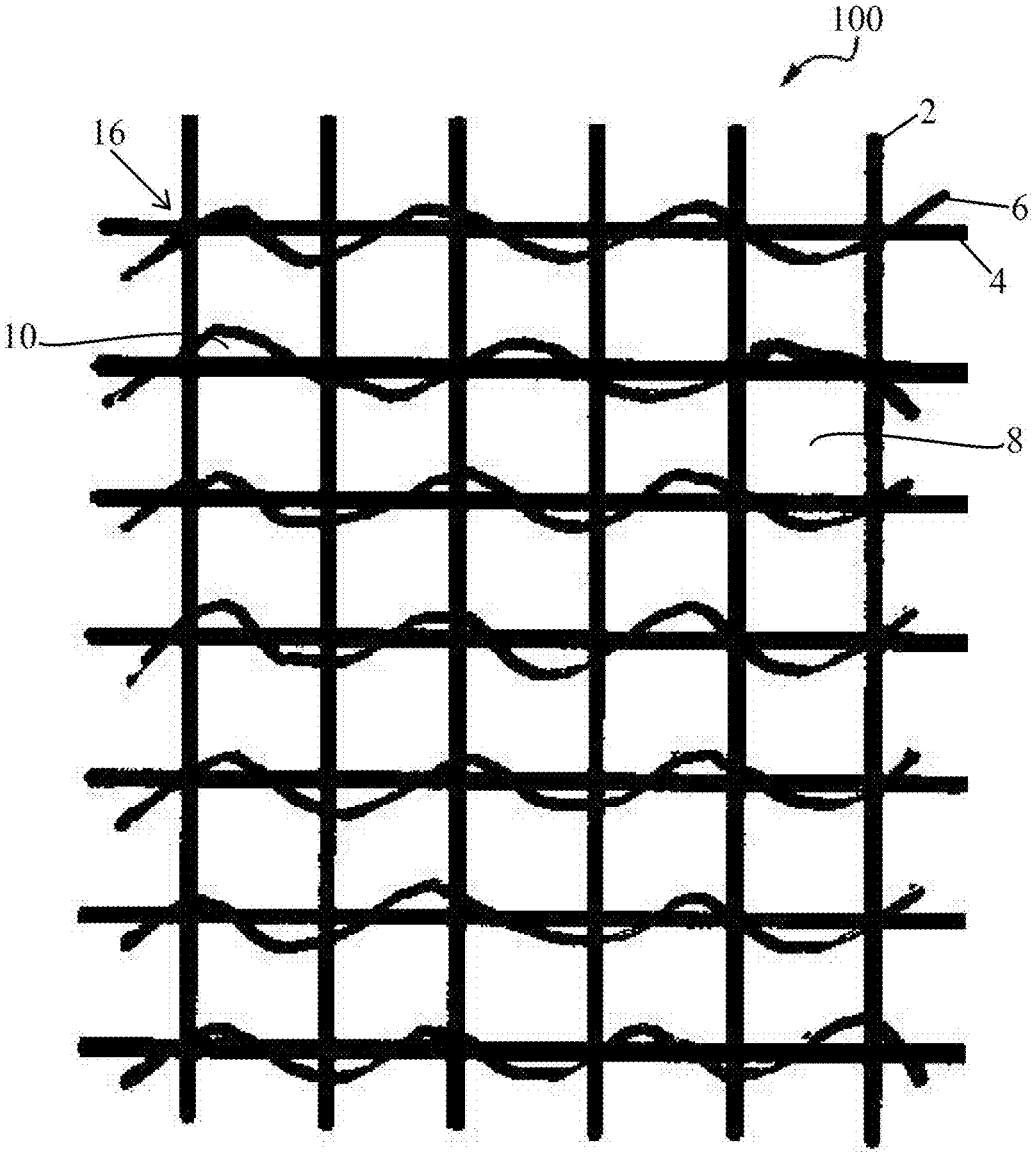
FIG. 1 depicts a view of an embodiment of a woven mesh of the present invention.

The exemplary embodiments are best understood by referring to the drawings with like numerals being used for like and corresponding parts of the various drawings. While components of embodiments of the invention are herein depicted in a vertical or horizontal orientation, such orientation is for illustration only and other orientations are contemplated.

Referring to FIG. 1, an embodiment of a leno weave mesh of the present invention is depicted. As used herein the term "leno weave" means a weave in which a plurality of warp yarns are twisted around the weft yarns. In the embodiment of FIG. 1, a woven mesh 100 comprises weft yarns 2, and warp yarns 4 and 6. As shown in the embodiment of FIG. 1, weft yarns 2 run in a common direction (vertically in this depiction), while warp yarns 4 and 6 run in a direction substantially perpendicular to weft yarns 2 (i.e., horizontally in this depiction). In other embodiments of the present invention (not shown), a woven mesh may comprise a plurality of weft yarns and a warp yarn, wherein at least one weft yarn has features and properties as described herein with regard to warp yarn 6, and the woven mesh has features and properties as described herein with regard to woven mesh 100. In the embodiment of FIG. 1, the woven mesh 100 comprises a plurality of cells 8 formed by the intersections of weft yarns 2 and warp yarns 4.

In the embodiment of FIG. 1, weft yarns 2, warp yarns 4, and warp yarns 6 are shown as separate, individual strands of yarn, however, this depiction is utilized merely for simplicity and as one skilled in the art would understand, in practice a woven mesh 100 is typically produced utilizing long yarn strands wherein each of weft yarns 2, warp yarns 4, and warp yarns 6 would comprise a single, contiguous strand of yarn. In various embodiments, however, yarns may be changed during the weaving process and therefore a woven mesh 100 may comprise weft yarns 2, warp yarns 4, and/or warp yarns 6 comprising different materials and/or dimensions. Thus, for simplicity of description only, the term "yarns" herein encompasses a single strand of yarn or a plurality of yarn strands.

In the embodiment of FIG. 1, weft yarns 2 and warp yarns 4 comprise a material having a relatively high melting point/range (temperature). In one embodiment, such high melting temperature weft yarns 2 and warp yarns 4 preferably retain at least 80% of their tensile strength at 343° C., more preferably retain at least 80% of their tensile strength at 849° C., and most preferably retain at least 80% of their tensile strength at 1200° C. In one embodiment, weft yarns 2 and/or warp yarns 4 comprise a carbon fiber material. In one embodiment, such carbon fiber material comprises a Torayca® T300 fiber available from Toray Carbon Fibers America, Inc. of Santa Ana, Calif. In other embodiments, weft yarns 2 and/or warp yarns 4 may comprise materials such as, but not limited to, boron, graphite, carbides (such as, but not limited to, silicon carbide or titanium carbide), borides (such as, but not limited to, titanium diborides), oxides (such as, but not limited to, alumina or silica), metals (such as, but not limited to, stainless steel), or ceramic. Weft yarns 2 and warp yarns 4 may comprise the same or different material(s).

In one embodiment, warp yarns 6, which one skilled in the art might designate as "skeleton" or "doup" yarns, are longitudinally disposed twistingly around (intertwined with) warp yarns 4. In one embodiment, warp yarns 6 comprise a material having a relatively low melting point/range (temperature). In one embodiment, such low temperature warp yarns 6 have a melting temperature of about 280° F. to about 300° F. In one embodiment, warp yarns 6 comprise one or more thermoplastic materials, such as, but not limited to, polyamide (e.g., nylon), polyester, and polyether sulfone (PES). In one embodiment, warp yarns 6 comprise or be synthesized from one or more non-synthetic materials, such as, but not limited to, glass, fiber glass, polylactic acid (PLA). In one embodiment, warp yarns 6 consist essentially of one or more such materials having such a relatively low melting temperature.

Although in FIG. 1 warp yarns 6 are depicted as being disposed about warp yarns 4 such that there are gaps 10 there between, such depiction is merely to illustrate the wrapped nature of warp yarns 6 around warp yarns 4, and in various embodiments (see, e.g., FIG. 2), warp yarns 6 may be disposed in substantially continuous contact with warp yarns 4, except where warp yarns 6 contact or otherwise cross weft yarns 2.

Figure 2:
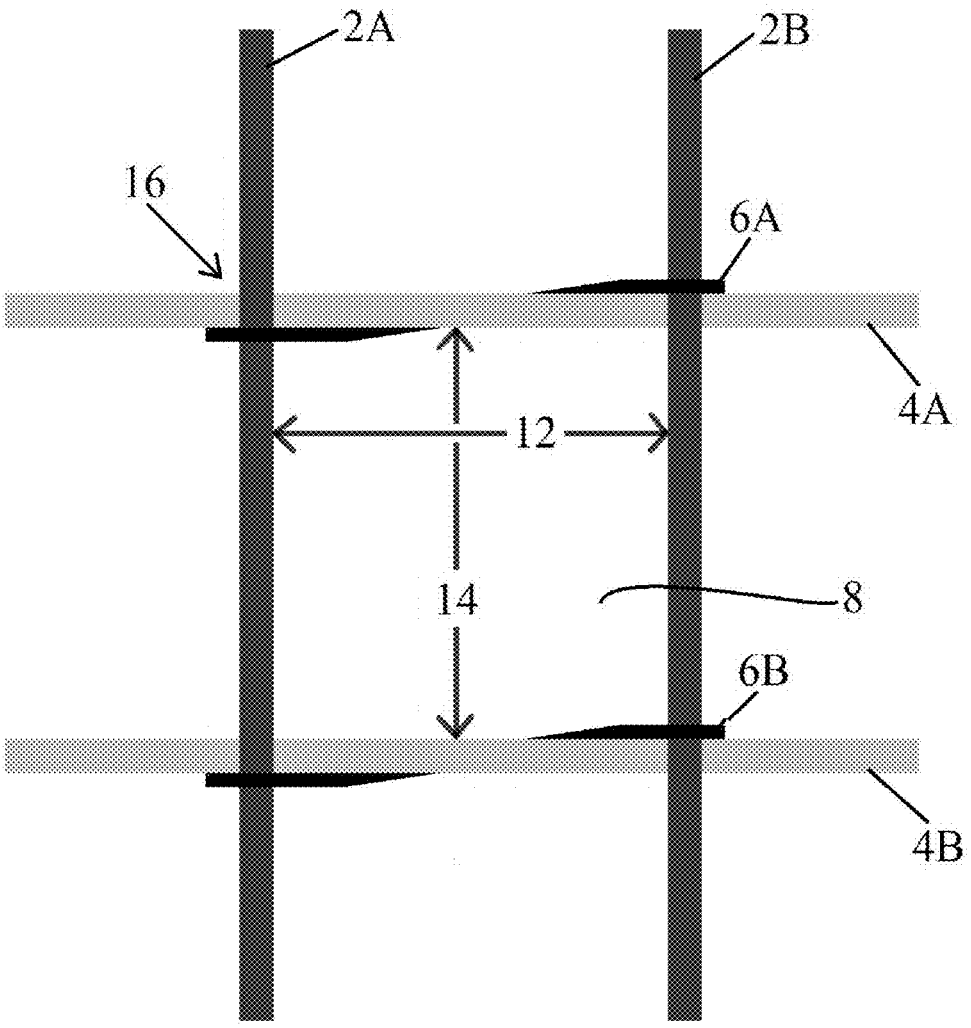
FIG. 2 depicts a view of a cell of an embodiment of a woven mesh of the present invention.
Figure 3:
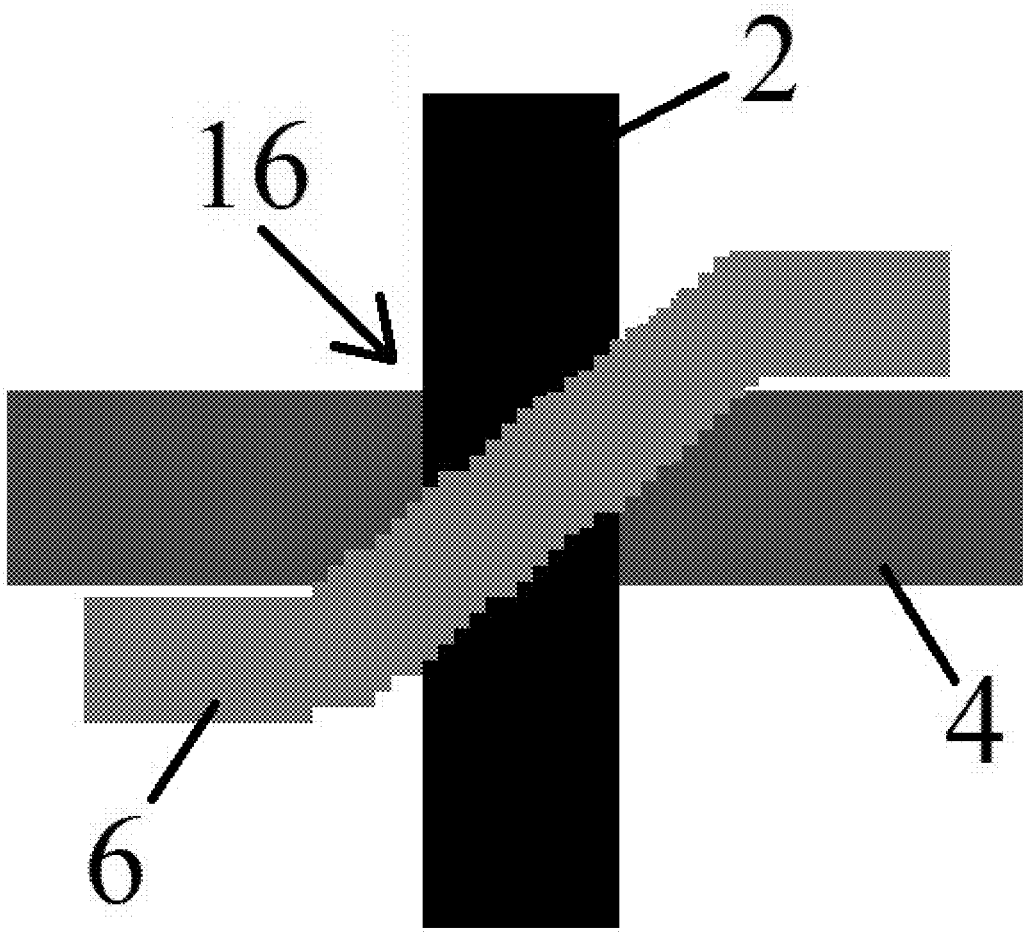
FIG. 3 depicts a view of a cell corner of an embodiment of a woven mesh of the present invention.

Referring now to FIG. 2, an embodiment of a single cell 8 from FIG. 1 is depicted. As shown in the embodiment of FIG. 2, a cell 8 generally comprises boarders of two weft yarns 2 (2A and 2B) and two warp yarns 4 (4A and 4B). In this embodiment, the distance between weft yarns 2A and 2B is depicted by arrow 12, and the distance between warp yarns 4A and 4B is depicted by arrow 14. In the embodiment of FIG. 2, cell 8 is substantially square in shape, although the invention is not so limited and other shapes may be utilized. In addition, cells 8 within a woven mesh 100 may be of the same shape or comprise different shapes, and may comprise the same or different areas there within. While the area of cells 8 may be varied as desired, in one embodiment cells 8 comprise weft yarns 2 and warp yarns 4 that are both spaced at about 2.5 yarns per inch.

In various embodiments, warp yarns 6 may comprise substantially round fibers, although the invention is not so limited and other shaped fibers may be employed. In this embodiment, the diameter of warp yarns 6A and 6B, which may be the same or different, is significantly smaller than the diameter of warp yarns 4A and 4B, although the invention is not so limited and other relative dimensions may be employed. In addition, relative spacing (frequency) of wrappings of warp yarns 6A or 6B around warp yarns 4A and 4B, respectively, may be varied as desired, and may be consistent or non-consistent within the woven mesh 100.

In various embodiments, weft yarns 2 and warp yarns 4 may comprise substantially round fibers, although the invention is not so limited and other shaped fibers may be employed. In the embodiment of FIG. 2, weft yarns 2 and warp yarns 4 comprise substantially similar diameters, although the invention is not so limited and other relative dimensions may be employed.

While the two-dimensional FIGS. 1 and 2 do not depict the relative positioning of warp yarns 4 and 6 with respect to their intersection with weft yarns 2, as is typical of leno weaves and would be understood by one skilled in the art, warp yarns 4 and 6 alternate their side-by-side positioning with each weft yarn 2 insertion; i.e., at each corner 16 of cells 8, the warp yarn 4 and the warp yarn 6 cross the weft yarn 2 on opposite sides of the plane in which the woven mesh 100 resides.

In one embodiment, utilizing techniques known to those skilled in the art, weft yarns 2 are woven with warp yarns 4 and 6 to provide a woven mesh 100 as depicted in FIG. 1. This provides some mechanical locking of weft yarns 2 with warp yarns 4 and 6. In one embodiment, heat is applied to the woven mesh 100 during the weaving process, whereby the warp yarns 6 are heated above their melting temperature(s) so that the warp yarns 6 are at least partially melted. In one aspect, the surface of the at least partially melted warp yarns 6 adheres to the warp yarns 4 and weft yarns 2 at contact points there between. In one embodiment, the woven mesh 100 may be constructed at typical weaving temperatures (such as substantially room temperature), and the produced woven mesh 100 is then heated so that the warp yarns 6 are at least partially melted, whereby the surface of the at least partially melted warp yarns 6 adheres to the warp yarns 4 and weft yarns 2 at contact points there between. The woven mesh 100 is allowed to cool whereby the warp yarns 6 re-solidify, thereby providing additional locking of the yarns and further preventing dimensional distortion of cells 8.

In various embodiments, a woven mesh 100 may be produced by one skilled in the art on a standard rapier loom, although the invention is not so limited and other looms or weaving devices may be employed. In one embodiment, a rapier loom available from Lindauer DORNIER GmbH of Lindau, Germany may be utilized to produce a woven mesh 100.

Experimental Results

Figure 6:
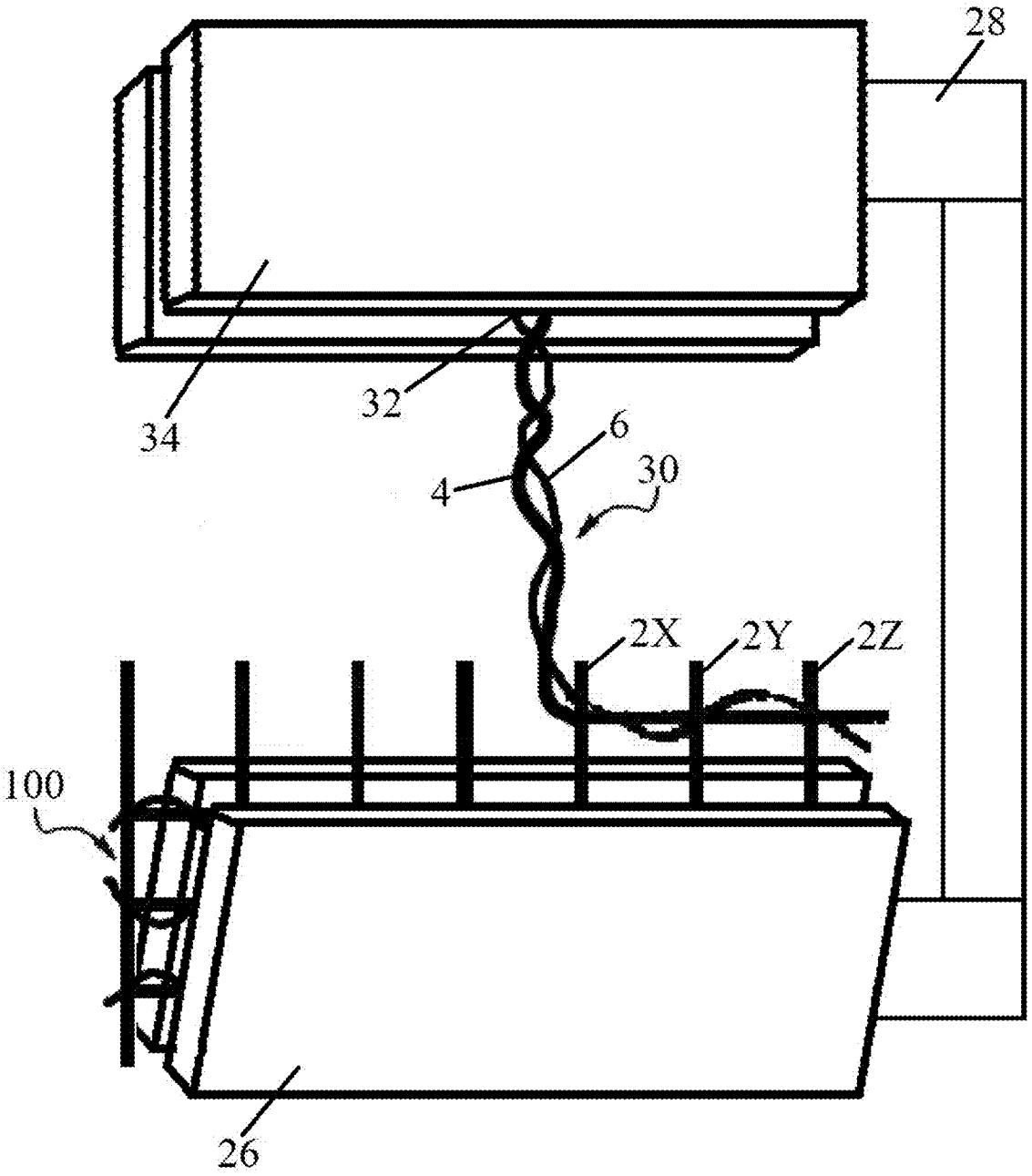
FIG. 6 depicts a testing apparatus and sample positioning used to test properties of an embodiment of a woven mesh of the present invention.
Figure 7:
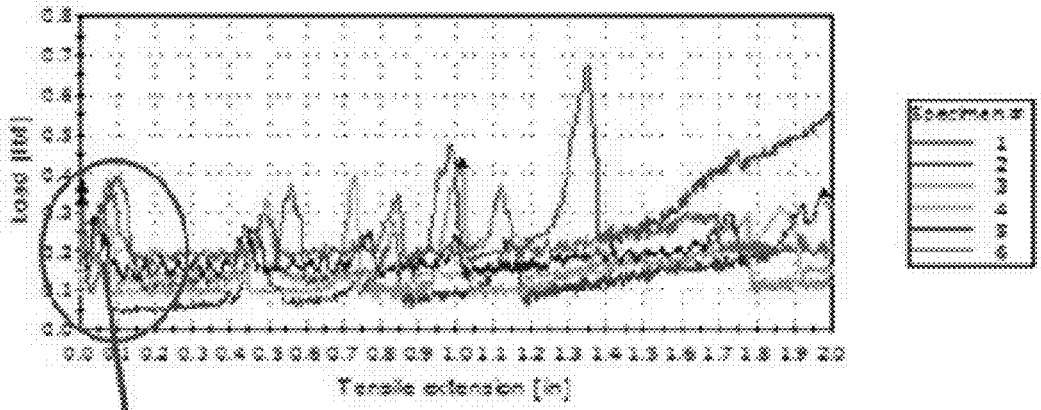
FIG. 7 depicts graphically the disengagement force required to separate yarns as depicted in the embodiment of FIG. 6.
Figure 8:
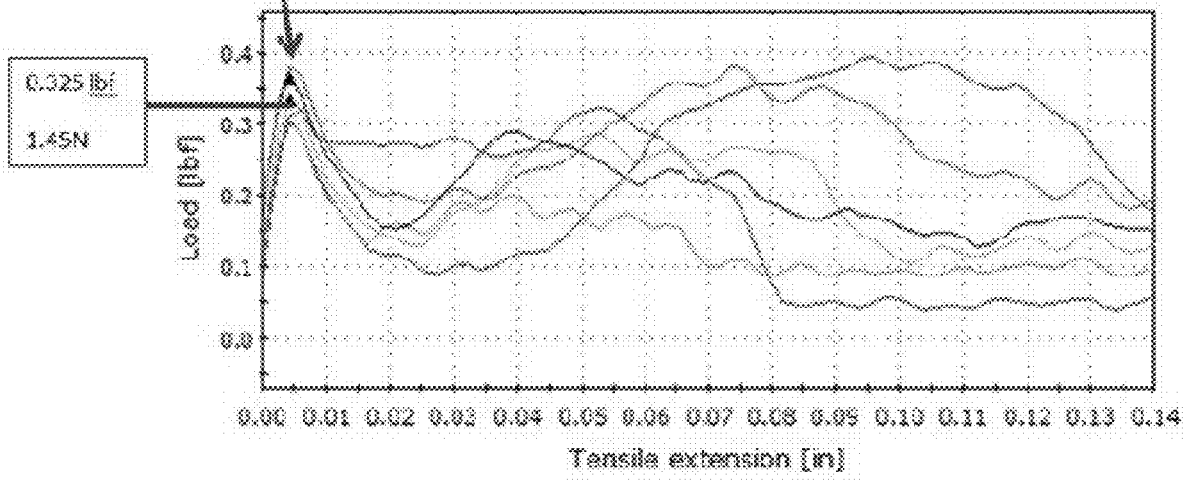
FIG. 8 depicts the encircled portion of the graphic depiction of FIG. 7.

In order to test the stability of an embodiment of a woven mesh 100 of the present invention, a sample of the woven mesh 100 was manipulated as follows:

A sample of woven mesh 100, having dimensions of about 5 inches in the warp yarn dimension and about 4 inches in the weft yarn direction, comprising weft yarns 2 and warp yarns 4 comprising 3K carbon fibers, 678 denier warp yarns 6 comprising polyamide (nylon), and comprising cells 8 having a substantially square geometry of about 10 millimeters by about 10 millimeters, was cut from a woven mesh 100 produced as described above. Terminal intertwined warp yarns 4 and 6 (item 30 in FIG. 6) were manually disengaged (peeled) from the weft yarns 2 proximate one edge of the mesh sample along about one-half of the sample. As shown in FIG. 6, the woven mesh 100 sample was then partially restrained within a first vice-like gripping mechanism component 26 of an Instron® tension measurement device 28 obtained from Illinois Tool Works Inc., wherein most of the woven mesh 100 sample, with the specific exception of the terminal intertwined warp yarns 30 that had been disengaged from several weft yarns 2, was restrained within the first gripping mechanism 26. Proximate a distal end 32 thereof, the intertwined warp yarns 30 were restrained within a second vice-like gripping mechanism component 34 of the tension measurement device 28. The tension measurement device 28 was then operated whereby the second gripping mechanism 34 was manipulated to be moved away from the first gripping mechanism 26, until the intertwined warp yarns 30 became disengaged from the next weft yarn 2X. The force required to so disengage the intertwined warp yarns 30 from weft yarn 2X of multiple substantially identical woven mesh 100 specimens was measured by the tension measurement device 28, as depicted in FIG. 7. While the experiments further comprised disengaging the intertwined warp yarns 30 from additional weft yarns 2Y, 2Z, etc., the focus of the experiments was placed on the first disengagement; i.e., the separation of the intertwined warp yarns 30 from weft yarn 2X. The bond rupture energy required for the disengagement of the intertwined warp yarns 30 from weft yarn 2X was determined to have an average magnitude of about 0.325 pound-feet (lbf), or about 1.45 Newtons (N), as depicted more specifically in FIG. 8, which represents the encircled region of the graph depicted in FIG. 7.

Operation

As is known within the art, fire protection for substrates may be provided by first draping a substrate with a support structure (mesh material) and affixing the mesh thereto, and then impregnating the mesh with an intumescent fire resistant coating composition. Intumescent coatings are known in the art and are particularly useful in fire resistance. Intumescent coatings form a char when exposed to extreme heat. One example of such a coating composition may be obtained from Intumescent Associates Group (IAG), LLC, or Houston, Tex., as NanoChar®.

Figure 4:
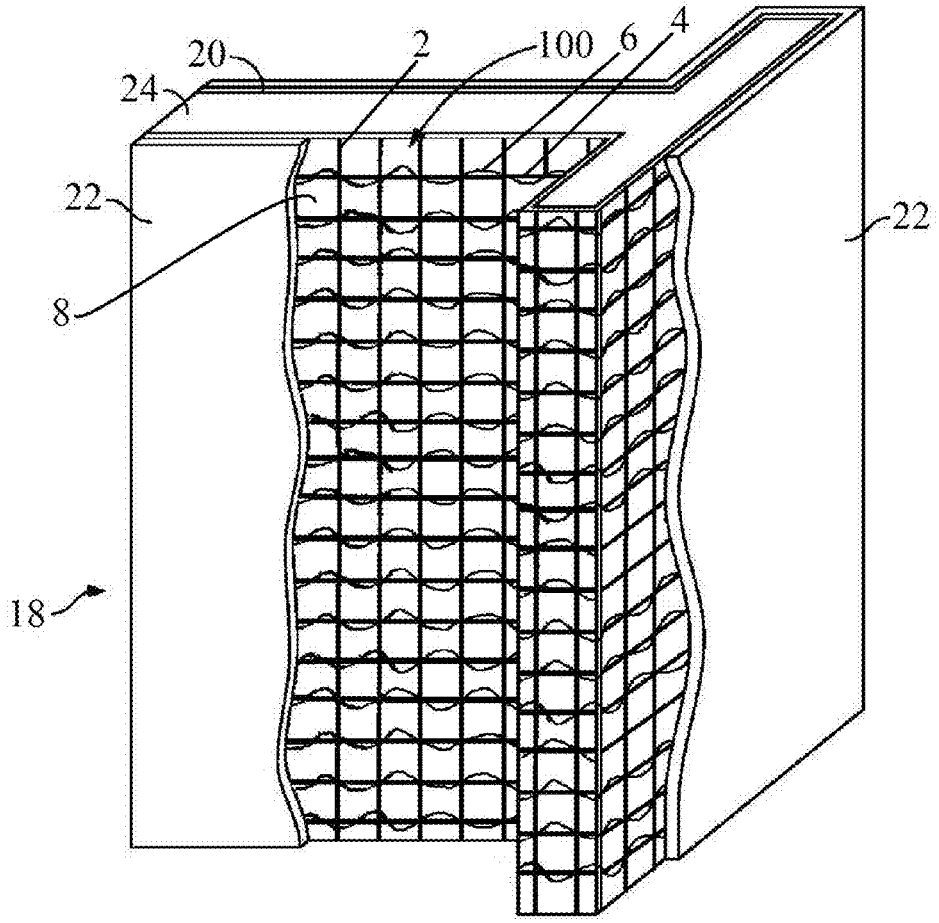
FIG. 4 depicts a perspective view of an embodiment of a coating system of the present invention provided on a substrate.

Referring to FIG. 4, an embodiment of a fire resistant coating system 18 is depicted in relation to an underlying substrate 24. The substrate 24 depicted is a section of an I-beam, however the invention is not so limited and other substrates, such as but not limited to, other building components, objects, or structures, may be employed. In one embodiment, an adhesive material 20 is applied to the exterior surface (not shown) of substrate 24. Generally, adhesive material 20 comprises a paste-like cement material placed on the substrate 24 to be protected, as is known within the art. Such application of adhesive material 20 may be by conventional application steps, including brushing, troweling, spraying, rollering, and the like.

In one embodiment, a layer of woven mesh 100 is then draped about the substrate 24, whereby the woven mesh 100 is affixed thereto by the adhesive material 20. Generally, the woven mesh application step comprises pressing woven mesh 100 to the adhesive 20 by a form of pressure, which may include by hand, trowel, roller, or the like. In one aspect, the mesh material forms a support structure on the substrate 24 with regard to the coating composition 22 to be applied.

In one embodiment, a quantity of an intumescent fire resistant coating composition 22 is then applied to the mesh-covered substrate 24, wherein the coating composition 22 is provided on and above the exteriorly facing surface of the woven mesh 100, as well as at least partially within the cells 8 of the woven mesh 100. Such application may be by conventional application steps, including brushing, troweling, spraying, rollering, and the like. The fire resistant coating step may be repeated if additional coating 22 is required. In one aspect, such coatings 22 typically possess properties that allow for at least partial solidification (hardening) of the coating composition 22 on/within the woven mesh 100, whereupon finishing materials (not shown) may be applied over the dried coating 22.

In one aspect, the cellular stability of woven mesh 100 minimizes deformation thereof during affixation of the woven mesh 100 to the substrate 24 and during provision of the coating composition 22 to the woven mesh 100. During exposure of the thus coated substrate to fire and/or extreme temperatures, the coating material 22 decomposes to form a protective char layer which at least partially protects the substrate 24 from thermal damage. With char formation, the protective coating 22 expands. The woven mesh 100 is particularly useful in relation to an intumescent fire resistant coating 22 as it expands in multiple directions to accommodate expansion of the protective coating 22 resulting from char formation. Woven mesh 100 thus assists in reducing cracking of the charred coating 22 and helps maintain adherence of the charred coating 22 to the substrate 24.

Figure 5:
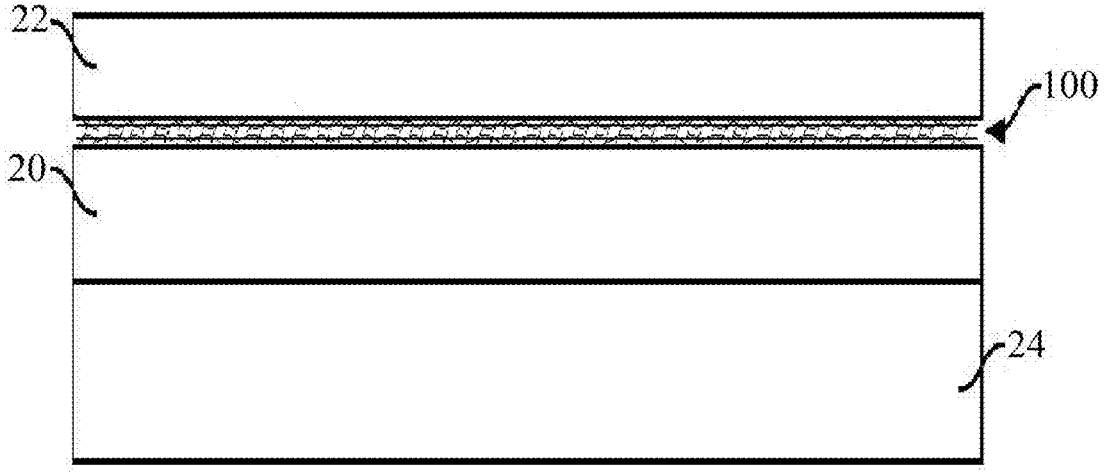
FIG. 5 depicts a side view of an embodiment of a coating system of the present invention provided on a substrate.

Referring now to FIG. 5, a side view of a segment of an installed fire resistant coating system 18 is depicted, including a substrate 24, an adhesive material 20 applied to substrate 24, a woven mesh 100 applied to the adhesive material 20, and a fire resistant coating 22 applied to the woven mesh support structure 100 and adhesive material 20. Field application of the fire resistant coating system 18 will result in less-clearly-defined demarcation between the support structure (woven mesh 100), adhesive material 20, and protective coating 22 than the depiction of FIG. 5. Instead, woven mesh 100 will be at least partially embedded in adhesive material 20, woven mesh 100 will be partly embedded in intumescent coating 22, and intumescent coating 22 will be attached to adhesive material 20 in the voids (cells 8) between the strands (weft yarns 2 and warp yarns 4) and in any gaps 10 between warp yarns 6 and warp yarns 4 (or weft yarns 2) of support structure 100.

Method

An embodiment of a method of utilizing embodiments of a woven mesh 100 of the present invention to provide heat/fire resistance to a substrate comprises the following steps:

An Adhesive Application Step of applying an adhesive material, such as adhesive material 20, to a substrate, such as substrate 24.

A Support Structure Application Step of draping a support structure, such as woven mesh 100, to the adhesive-covered substrate.

A Fire Resistant Coating Application Step of applying a fire resistant coating, such as intumescent coating composition 22, to the adhesive-and-support-structure-covered substrate.

The method described above is merely exemplary, and additional embodiments of providing heat and/or fire resistance to a substrate utilizing embodiments of a woven mesh 100 of the present invention consistent with the teachings herein may be employed. In addition, in other embodiments, one or more of these steps may be combined, repeated, re-ordered, or deleted, and/or additional steps may be added.

While the preferred embodiments of the invention have been described and illustrated, modifications thereof can be made by one skilled in the art without departing from the teachings of the invention. Descriptions of embodiments are exemplary and not limiting. The extent and scope of the invention is set forth in the appended claims and is intended to extend to equivalents thereof. The claims are incorporated into the specification. Disclosure of existing patents, publications, and known art are incorporated herein by reference to the extent required to provide details and understanding of the disclosure herein set forth.

We claim:

1. A woven mesh support structure comprising:
a plurality of first yarns;
a plurality of second yarns; and
a plurality of third yarns;
wherein:
said first and second yarns retain at least about 80% of their tensile strength at about 343° C.; at least some said first and second yarns comprise a carbon fiber material;
said third yarns have a melting temperature range of about 280° F. to about 300° F.;
said yarns are woven in a leno weave arrangement;
each said third yarn is intertwined with one said second yarn;
each said intertwined pair of second and third yarns is positioned in said woven mesh such that said third yarn and said second yarn thereof are disposed alternatingly on either side of said first yarn at intersections of said yarns;
said woven mesh is exposed to elevated temperatures whereby at least a portion of the surface of said third yarns is at least partially melted, wherein upon cooling, at least a portion of the surface of each said third yarn adheres to the surface of each said first yarn and said second yarn at contact points there between; and
the bond rupture energy required to disengage a pair of said intertwined second and third yarns from a said first yarn is about 0.325 pound-feet.

2. The woven mesh support structure of claim 1, wherein:
said first yarns run in a weft direction; and
said second and third yarns run in a warp direction.

3. The woven mesh support structure of claim 1, wherein:
said first yarns run in a warp direction; and
said second and third yarns run in a weft direction.

4. The woven mesh support structure of claim 1, wherein at least some of said first and second yarns retain at least about 80% of their tensile strength at about 849° C.

5. The woven mesh support structure of claim 1, wherein at least some of said first and second yarns retain at least about 80% of their tensile strength at about 1200° C.

6. The woven mesh support structure of claim 1, wherein at least some of said third yarns comprise a thermoplastic material selected from the group consisting of:
a polyamide;
a polyester; and
a polyether sulfone.

7. The woven mesh support structure of claim 1, wherein said mesh comprises substantially square mesh cells.

8. The woven mesh support structure of claim 1, wherein at least some of said first yarns and some of said intertwined second and third yarns are spaced at about 2.5 yarns per inch of mesh.

9. An intumescent coating system, comprising:
(A) a substrate to which an adhesive material has been applied to the exterior surface thereof;
(B) a quantity of woven mesh draped about said substrate, whereby said woven mesh is affixed to said substrate by said adhesive material, and wherein said mesh comprises:
a plurality of first yarns;
a plurality of second yarns; and
a plurality of third yarns;

wherein:

said first and second yarns retain at least about 80% of their tensile strength at about 343° C.; at least some said first and second yarns comprise a carbon fiber material;

said third yarns have a melting temperature range of about 280° F. to about 300° F.;

said yarns are woven in a leno weave arrangement;

each said third yarn is intertwined with one said second yarn;

each said intertwined pair of second and third yarns is positioned in said woven mesh such that said third yarn and said second yarn thereof are disposed alternatingly on either side of said first yarn at intersections of said yarns;

said woven mesh is exposed to elevated temperatures whereby at least a portion of the surface of said third yarns is at least partially melted, wherein upon cooling, at least a portion of the surface of each said third yarn adheres to the surface of each said first yarn and said second yarn at contact points there between; and the bond rupture energy required to disengage a pair of said intertwined second and third yarns from a said first yarn is about 0.325 pound-feet; and (C) an intumescent coating composition applied to said mesh-draped substrate, wherein said intumescent coating composition impregnates at least a portion of said woven mesh.

10. The intumescent coating system of claim 9, wherein said substrate comprises a building component or a structure.

11. The intumescent coating system of claim 9, wherein said substrate comprises an I-beam.

12. A woven mesh support structure comprising:

a plurality of first yarns;

a plurality of second yarns; and a plurality of third yarns;

wherein:

said yarns are woven in a leno weave arrangement; at least some said first and second yarns comprise a carbon fiber material;

each said third yarn is intertwined with one said second yarn;

each said intertwined pair of warp yarns is positioned in said woven mesh such that said third yarn and said second yarn thereof are disposed alternatingly on either side of said first yarn at intersections of said yarns;

said woven mesh is exposed to elevated temperatures whereby at least a portion of the surface of said third yarns is at least partially melted, wherein upon cooling, at least a portion of the surface of each said third yarn adheres to the surface of each said second yarn and said first yarn at contact points there between; and the bond rupture energy required to disengage a pair of said intertwined warp yarns from a said weft yarn is about 0.325 pound-feet.

13. The woven mesh support structure of claim 12, wherein:

said first yarns run in a weft direction; and said second and third yarns run in a warp direction.

14. The woven mesh support structure of claim 12, wherein:

said first yarns run in a warp direction; and said second and third yarns run in a weft direction.

15. The woven mesh support structure of claim 12, wherein at least some of said first and second yarns retain at least about 80% of their tensile strength at about 849° C.

16. The woven mesh support structure of claim 12, wherein at least some of said first and second yarns retain at least about 80% of their tensile strength at about 1200° C.

17. The woven mesh support structure of claim 12, wherein at least some of said third yarns comprise a thermoplastic material selected from the group consisting of:

a polyamide;

a polyester; and a polyether sulfone.

18. The woven mesh support structure of claim 12, wherein said mesh comprises substantially square mesh cells.

19. The woven mesh support structure of claim 12, wherein at least some of said first yarns and some of said intertwined second and third yarns are spaced at about 2.5 yarns per inch of mesh.

20. An intumescent coating system, comprising:

(A) a substrate to which an adhesive material has been applied to the exterior surface thereof;

(B) a quantity of the woven mesh of claim 12 draped about said substrate, whereby said woven mesh is affixed to said substrate by said adhesive material, and (C) an intumescent coating composition applied to said mesh-draped substrate, wherein said intumescent coating composition impregnates at least a portion of said woven mesh.

* * * * *